US007429949B1

(12) United States Patent
Trigui

(10) Patent No.: US 7,429,949 B1
(45) Date of Patent: Sep. 30, 2008

(54) ROBUST BEAMFORMING BASED ON NULLS BROADENING AND VIRTUAL ANTENNA ELEMENTS

(75) Inventor: Hafedh Trigui, Ottawa (CA)

(73) Assignee: TenXc Wireless Inc., Ontario (CA)

( * ) Notice: Subject to any disclaimer, the term of this patent is extended or adjusted under 35 U.S.C. 154(b) by 0 days.

(21) Appl. No.: 11/890,136

(22) Filed: Aug. 3, 2007

(51) Int. Cl.
*H01Q 3/00* (2006.01)

(52) U.S. Cl. ..... 342/372

(58) Field of Classification Search ..... 342/372, 342/368, 377
See application file for complete search history.

(56) References Cited

U.S. PATENT DOCUMENTS 6,061,023 A * 5/2000 Daniel et al. ..... 342/373
2006/0109938 A1* 5/2006 Challa et al. ..... 375/350

OTHER PUBLICATIONS

K. Hugl et al., Downlink performance of adaptive antennas with null broadening, IEEE Vehicular Technology Conference, vol. 1, p. 872-876, May 1999.*

P.D. Karaminas et al., Super-resolution broad null beamforming for cochannel interference cancellation in mobile radio networks, IEEE Transactions on Vehicular Technology, vol. 49, p. 689-697, May 2000.*

Z. Xu et al., Modified null broadening adaptive beamforming: constrained optimisation approach, Electronics Letters, vol. 43(3), p. 145-146, Feb. 2007.*

* cited by examiner

*Primary Examiner*—Thomas H. Tarcza
*Assistant Examiner*—Fred H. Mull
(74) *Attorney, Agent, or Firm*—Townsend and Townsend and Crew LLP

(57) ABSTRACT

A method and system for generating beamforming weights for a plurality of antenna elements is disclosed. The invention consists of generating broadened nulls in a direction of arrival corresponding to one or more co-channel interference signals. The broadened nulls permit deviations in the measurement of the direction of arrival or variations therein. The increased information content inherent in generating the broadened nulls is accommodated by postulating the existence of a virtual augmented antenna array comprising the antenna elements of the physical array and a plurality of additional virtual elements. The beamforming weights for the elements of the augmented array are truncated down prior to translation to the size of the physical array and are applied to create the desired broadened nulls and thereby improve system performance.

29 Claims, 3 Drawing Sheets

ROBUST BEAMFORMING BASED ON NULLS BROADENING AND VIRTUAL ANTENNA ELEMENTS

FIELD OF THE INVENTION

The present invention relates to wireless communications systems and in particular to a novel system for broadening nulls in the case of limited number of antenna elements.

BACKGROUND TO THE INVENTION

In wireless communication systems, the frequency spectrum is a scarce resource that calls for efficient use. Such, efficiency was first obtained by dividing a geographic area into smaller regions or cells and to assign a limited number of frequency channels to each cell.

Depending upon the access technique, the frequency channels might or might not be re-used in adjacent cells. For frequency division multiple access (FDMA) systems, such as is disclosed in the Global System for Mobile Communications (GSM) standard, it is preferred that adjacent cells do not share the same frequency channels, so as to mitigate any co-channel interference. In such systems, in order to provide a minimum quality of service, which is related to signal to interference plus noise ratio (SINR), a minimum distance is maintained between cells that use the same frequency channels. Thus, only a subset of the available frequency bandwidth is used, but in a plurality of cells of a cellular network.

In order to further increase capacity, the paradigm that a frequency channel is allocated to a single user has also been supplanted, such as by the time division multiple access (TDMA) technique employed in the GSM standard, wherein a particular user transmits and/or receives in a limited number of periodic time intervals or packets or time slots. In the GSM system, the time bandwidth is divided into frames of eight packets. Thus, up to 8 users could share a single frequency channel within a cell without risk of interference. Accordingly, the maximum number of users per cell that could be simultaneously connected to a base transceiver station (BTS) servicing the cell is the product of the number of frequency channels allocated to the cell and the number of time slots per channel.

Typically, communications between a user or subscriber station (SS) and the base transceiver station takes place across two links, designated the forward or downlink (DL) from the base transceiver station to the subscriber station and reverse or uplink (UL) from the subscriber station to the base transceiver station. The allocated frequency channels per cell could be used by both links, for example, in time division duplex (TDD) systems. Alternatively, one could allocate all of the channels to a single link. In such a case, for instance in frequency division duplex (FDD) systems found in the GSM standard, either the number of channels would have to be duplicated or half of the allocated channels would be used for the downlink and half of them would be used for the uplink, effectively halving the user capacity.

From an implementation point of view, two antennas could be used in FDD systems, one of which could be assigned to the receive function and the other to the transmit function. Alternatively, a single antenna could be used for both transmit and receive functions. In such a case, transmit and receive chains would be separated by some means, such as by a duplexer and accompanying filters.

In early embodiments of wireless communications systems, antennas were designed with a geographically constant radiation pattern intended to cover the associated cell region. Depending upon the cell size, the antenna's transmit power would be optimized to cover the entirety of the cell, taking into account such parameters as propagation environment, transmit power and losses in the transmit chain, all of which potentially affect the maximum reach of the antenna. For simplicity, initial cell antennas were omni-directional and transmitted constant power in all directions from the antenna location in the centre of the cell.

Later developments included sectorization as a mechanism for further capacity increase. In sectorization approaches, the antenna was made directional and its beam-width was limited, so that the cell size or coverage area was limited not only by the maximum reach of the antenna but also by the angular space covered by it. Conceptually, if an omni-directional antenna was represented by a circular disk, a sectorized antenna could be represented by a limited pie-shaped slice of the disk. While in theory, an antenna could be designed to have any desired beam width, typically, beam widths have tended to be either 33°, 45°, 65°, 85°, 90° or 105°.

Currently, most implementations deploy tri-sectorization in which a cell is split into 3 sectors of approximately 120° each. An antenna having a 90° beam width services each sector and the three antennas are co-located. Thus, the real estate cost of such implementations is reduced because a single site supports three sectors. As well, because the sectors are outward facing, co-channel interference is minimized. The sectors however, are not necessarily equal in size. Rather the sector design is primarily predicated upon user distribution.

Were interference the only factor to be considered in network design, higher order sectorization would be preferable, with a practical upper bound being hex-sectorization. However, the number of users being in handover increases dramatically as the sector width decreases. Furthermore, in older implementations, where cells are closely packed, it is difficult to increase the level of sectorization.

Thus, as user capacity levels become saturated, other capacity increase methodologies have gained prominence. Chief among these methodologies is spatial filtering, or beamforming, in which a narrow beam is pointed to a particular user and adapted to track the geographical position of the user. In beamforming systems, multiple copies of the signal are received through multiple antenna elements and combined in such a way as to increase the signal to noise ratio (SNR) or the SINR.

In some beamforming systems, rather than directing energy to where the user is located, nulls in the radiation pattern generated by an antenna are systematically generated where co-channel interferers are located.

The location of such interferers may be identified because in the uplink direction, the data packet contains information known to the base transceiver station receiver and used by it to generate a vector of weights (magnitudes, phases or magnitudes and phases) that combine the antenna signals so as to form a beam directed toward the user or a null directed toward interferers. For example, in the GSM standard, provision is made for the inclusion within the data packet of a known training sequence that identifies the user and provides opportunity for the propagation environment to be ascertained.

In TDD systems, because the subscriber station communicates with the base transceiver station in both directions along the same channel frequency, the vector of weights determined in the uplink direction can be reused in the downlink direction, assuming that the propagation environment parameters are relatively constant across the short interval between the uplink and downlink communications.

By contrast, in FDD systems, the channel parameters of the downlink direction are uncorrelated with those of the uplink direction. Thus, in such systems, the base transceiver station transmitter predicts the channel parameters for the downlink direction based on certain knowledge of the channel parameters of the uplink direction such as the direction of arrival (DoA) and averaged powers, again on the assumption that these parameters remain relatively constant and are independent of the particular channel frequency used.

Thus, the base transceiver station transmitter could build weight vectors for the antenna array in order to produce appropriate beams and/or nulls in accordance with the channel invariant parameters from the uplink. Such null steering and beamforming approaches are, in theory, effective in situations where the desired and interfering signals are sufficiently separated in angular space. The amount of separation called for is related to the size of the antenna array.

Nevertheless, it is recognized by those having ordinary skill in this art that such approaches, especially null steering approaches, suffer from robustness issues because of the relatively narrow nulls or wide beams that are generated. For example, sometimes the interferer is so close in angular direction to the user that broad nulls will not be generated in the direction of the interferer for fear of dropping communications with the user.

Where relatively narrow nulls are created, a small error in the array calibration or in the estimated position of the interferer, such as by motion of the interferer in angular space, will result in the null being directed at an angle away from the appropriate location. If the calibration error is small, the impact on the interference cancellation ability of the beamforming system for forward link will be less significant. However, as the error increases, whatever interference cancellation ability is obtained may be significantly attenuated or wiped out entirely.

Thus, some approaches implement null broadening schemes so as to mitigate the detrimental impact of calibration error on the performance of the beamforming system, to ensure the actual performance approximates, as closely as possible, the theoretical performance gains available with null steering techniques. In other words, the objective is to avoid dramatic degradation in the performance in such situations.

Those having ordinary skill in the art will recognize that null broadening techniques are relatively simple with a large number of elements in the antenna array. However, in practical implementations, in order to keep system costs at a moderate level, the number of elements is typically kept small. In such situations, the ability to provide null broadening is compromised.

For example, null broadening is typically considered a constrained optimization problem, which involves iteration over a long period of time in order to converge to a solution. To reduce the complexity, certain of the constraints may be alleviated. For example, the number of interferers could be reduced or combined in a desired broadened null location in order to simplify the iterative algorithm.

Accordingly, it is desirable to provide a means of broadening nulls with a limited number of elements in the antenna array.

SUMMARY OF THE INVENTION

The present invention accomplishes these aims by providing a system for broadening nulls directed at a co-channel interferer by notionally considering an augmented virtual antenna array having a greater number of elements than physically exist. Using this augmented virtual array, with its increased number of antenna elements, a broadened null may be conceptually generated in the direction of the interferer thus providing greater noise immunity for errors in the estimate of the angular position of the interferer, and/or making provision for change in the angular position of the interferer.

The augmented virtual antenna array, with its additional antenna elements may be mapped back to the physical array for implementation, with negligible impact on the broadened nulls.

According to a first broad aspect of an embodiment of the present invention, there is disclosed a method of generating beamforming weights for a plurality of antenna elements in a physical array thereof, the method comprising: estimating a direction of arrival of a co-channel interfering signal; deriving a first series of beamforming weights corresponding to each antenna element in the physical antenna array, wherein the series of derived beamforming weights define a null in an angular direction from the physical antenna array corresponding to the direction of arrival of the interfering signal; broadening the null to accommodate deviation of the estimated direction of arrival from a true direction of arrival of the signal; identifying a series of virtual weights to accommodate information content of the broadened null corresponding to a virtual antenna array comprising a plurality of real antenna elements corresponding to the plurality of antenna elements of the physical array and a plurality of virtual antenna elements; and transforming the series of virtual weights to a second series of beamforming weights corresponding to each antenna element in the physical antenna array that incorporate the broadened null; wherein the second series of beamforming weights may be applied to the plurality of physical antenna elements to minimize interference from the co-channel interferer during communications with a desired user.

According to a second broad aspect of an embodiment of the present invention, there is disclosed a method of generating beamforming weights for a plurality of antenna elements in a physical array thereof, the method comprising: deriving a first series of beamforming weights corresponding to each antenna element in the physical antenna array, wherein the series of derived beamforming weights define a null in an angular direction from the physical antenna array; broadening the null to accommodate deviation in the angular direction; identifying a series of virtual weights to accommodate information content of the broadened null corresponding to a virtual antenna array comprising a plurality of real antenna elements corresponding to the plurality of antenna elements of the physical array and a plurality of virtual antenna elements; and transforming the series of virtual weights to a second series of beamforming weights corresponding to each antenna element in the physical antenna array that incorporate the broadened null; wherein the second series of beamforming weights may be applied to the plurality of physical antenna elements to minimize interference from a co-channel interfering signal during communications with a desired user.

According to a third broad aspect of an embodiment of the present invention, there is disclosed a beamforming system for communicating with a desired user along a physical antenna array having a plurality of antenna elements, comprising: an estimator for identifying an estimated direction of arrival of a co-channel interfering signal; a beamformer for deriving a first set of beamforming weights corresponding to each antenna element in the physical antenna array, wherein the series of derived beamforming weights defining a null in an angular direction from the physical antenna array corresponding to the direction of arrival; a null broadener to accommodate deviation of the estimated direction of arrival from a true direction of arrival of the signal in a broadened null; a mapper for mapping the first set of beamforming weights into a series of virtual weights adapted to accommodate information content of the broadened null and corresponding to a virtual antenna array comprising a plurality of real antenna elements corresponding to the plurality of antenna elements of the physical antenna array and a plurality of virtual antenna elements; and a transformer for transforming the series of virtual weights to a second series of beamforming weights corresponding to each antenna element in the physical antenna array that incorporate the broadened null; wherein the second series of beamforming weights may be applied to plurality of antenna elements in the physical antenna array to minimize interference from the co-channel interfering signal during communications with a desired user.

According to a fourth broad aspect of an embodiment of the present invention, there is disclosed a processor operatively coupled to a plurality of antenna elements in a physical antenna array thereof, comprising: an estimator for estimating a direction of arrival of a signal from a co-channel interfering signal; a beamformer for deriving a first series of beamforming weights corresponding to each antenna element in the physical antenna array, wherein the series of derived beamforming weights define a null in an angular direction from the physical antenna array corresponding to the direction of arrival; a filter for broadening the null to accommodate deviation of the estimated direction of arrival from a true direction of arrival of the signal; a modeler for identifying a series of virtual weights to accommodate information content of the broadened null corresponding to a virtual antenna array comprising a plurality of real antenna elements corresponding to the plurality of antenna elements of the physical array and a plurality of virtual antenna elements; and a translation machine for transforming the series of virtual weights to a second series of beamforming weights corresponding to each antenna element in the physical antenna array that incorporate the broadened null; wherein the second series of beamforming weights may be applied to the plurality of physical antenna elements to minimize interference from the co-channel interfering signal during communications with a desired user.

According to a fifth broad aspect of an embodiment of the present invention, there is disclosed a computer-readable medium in a processor operatively coupled to a plurality of antenna elements in a physical antenna array thereof, the medium having stored thereon, computer-readable and computer-executable instructions which, when executed by a processor, cause the processor to perform steps comprising estimating a direction of arrival of co-channel interfering signal; deriving a first series of beamforming weights corresponding to each antenna element in the physical antenna array, wherein the series of derived beamforming weights define a null in an angular direction from the physical antenna array corresponding to the direction of arrival; broadening the null to accommodate deviation of the estimated direction of arrival from a true direction of arrival of the signal; identifying a series of virtual weights to accommodate information content of the broadened null corresponding to a virtual antenna array comprising a plurality of real antenna elements corresponding to the plurality of antenna elements of the physical array and a plurality of virtual antenna elements; and transforming the series of virtual weights to a second series of beamforming weights corresponding to each antenna element in the physical antenna array that incorporate the broadened null; wherein the second series of beamforming weights may be applied to the plurality of physical antenna elements to minimize interference from the co-channel interfering signal during communications with a desired user.

BRIEF DESCRIPTION OF THE DRAWINGS

The embodiments of the present invention will now be described by reference to the following figures, in which identical reference numerals in different figures indicate identical elements and in which.

DETAILED DESCRIPTION OF THE PREFERRED EMBODIMENTS

Figure 1:
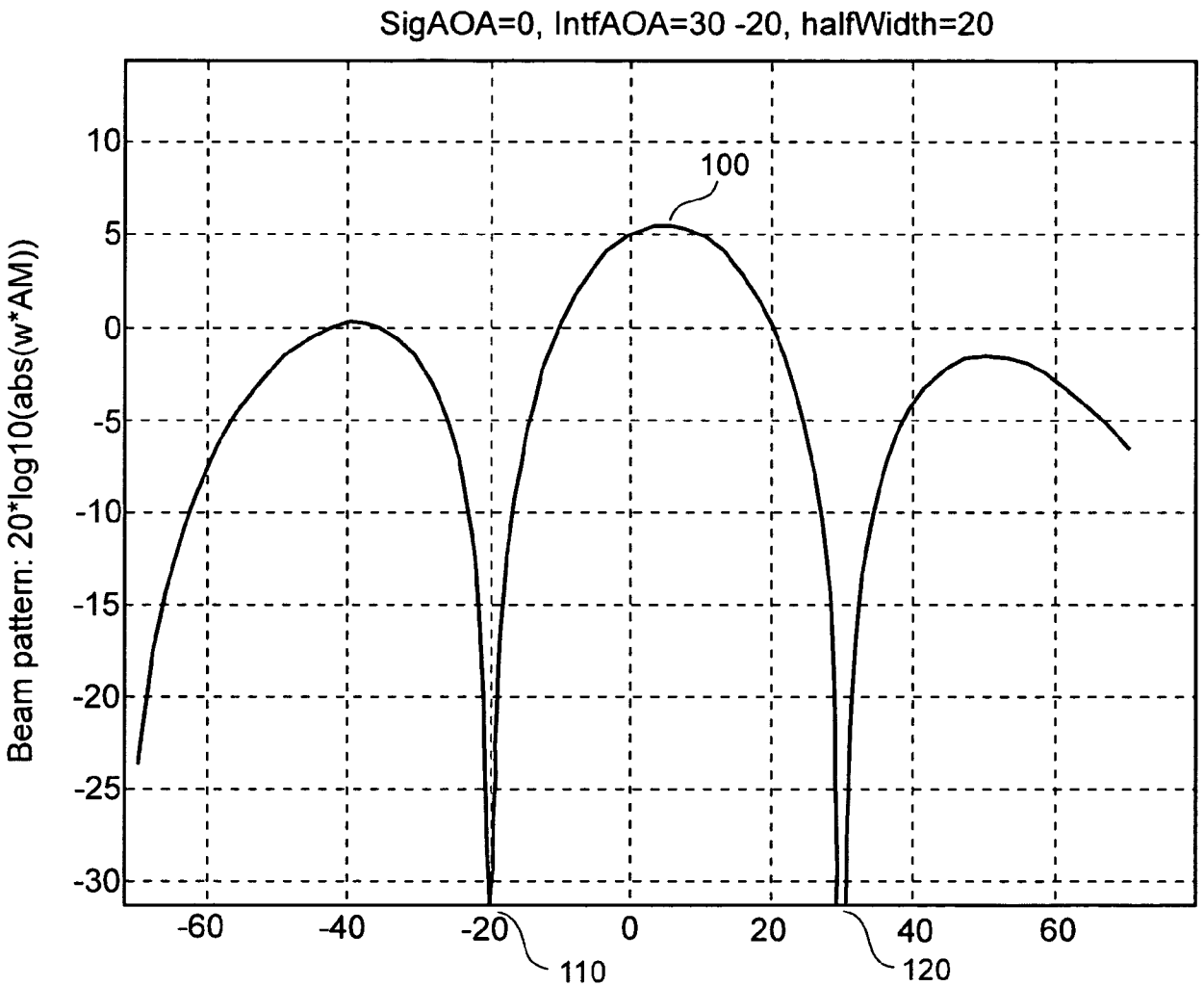
FIG. 1 is an exemplary graph of the beamformer response received by an exemplary base transceiver station in a cell as a function of angular direction for an antenna array of four elements.

Referring now to FIG. 1, there is shown an exemplary graph of the beamformer response, that may be computed at the base transceiver station for a specific cell, as a function of angular direction.

In a first exemplary scenario, this could be the response for the uplink direction upon the application of the vector of weights w associated with the receive antenna array signature a, which, in this, exemplary scenario has 4 antenna elements, and thus is of length m=4.

In FIG. 1, there are shown a plurality of peaks and valleys. The peak 100 corresponds to the angular direction of the desired user. The valleys 110, 120 correspond to nulls generated by the beamformer in conventional fashion and potentially corresponding to angular directions of identified co-channel interferers from other cells.

The information regarding the location of the nulls may be obtained in conventional fashion, such as by application of a DoA algorithm such as is well known to those having ordinary skill in this art. In such an algorithm, the known information about the desired signal incorporated in the data packets, such as the training sequence identifier, is used to distinguish between signals emanating from the user and those from co-channel interferers from other cells.

Alternatively, a simpler approach to derive the null location is to identify the local minima of the beamformer response formed by the vector of weights w and the spatial signature of the array a, such as is shown in exemplary fashion in FIG. 1.

The antenna response A shown in FIG. 1 may be theoretically denoted as $$A=|w\cdot a(\theta)|^2 \tag{1}$$

where w is the vector of weights applied by the beamformer, a is the antenna array spatial signature, and θ is the angular direction.

The antenna array spatial signature may be theoretically derived by calculating the inter-element phase change and signal amplitude of a notional incoming signal as a function of angular direction. Such calculations may be considerably simplified by assuming the incoming signal is a planar wave and calculating the time of arrival of the wave at each element.

Conceivably, the spatial signatures could be measured directly in a controlled environment such as an anechoic chamber.

However obtained, the array signatures may be stored by the base transceiver station for subsequent recall. The weights w are computed from received signals whereas the array signature is a characteristic of the array.

The covariance matrix of the received signals on the antenna array is computed from snapshots of the uplink received signal. A column of the inverse of the covariance matrix is a particular implementation of w.

From the application of Equation (1), the local maxima may correspond to a transmitting subscriber station and local minima may correspond to the presence of co-channel interfering signals.

Indeed, in some cases, more nulls will appear in the beamformer response than there are actual interferers. In such a scenario, one could identify false nulls unassociated with an interferer by comparing the powers of the signal emanating from the directions associated with the nulls, on the basis that if there is really an interfering signal in one of the identified directions, it will presumably have a strong power. Those having ordinary skill in this art will readily recognize that in such a scenario, the computational workload could be significantly reduced since only actual interferers' nulls are broadened.

One may then determine whether to perform nulls broadening, and if so, identify at which angular direction(s) to do so.

The exemplary beamformer response of FIG. 1 may be considered to represent a spectrum. If so, then conceivably digital signal processing techniques may be applied to the response.

Continuing the analogy, for uniform linear antenna arrays, one may consider beamforming operations as being equivalent to taking the Fourier transform of the vector of weights $w=[w_1{}^*w_2{}^*w_3{}^*w_4{}^*]$ using the signal response of $$\text{the array elements } a(\theta) = \begin{bmatrix} a_1(\theta) \\ a_2(\theta) \\ a_3(\theta) \\ a_4(\theta) \end{bmatrix}.$$

Thus, we denote the Fourier transform as $$W(f')=w\cdot a(\theta) \tag{2}$$

where $$f' = \frac{d}{\lambda}\sin(\theta),$$

d is the inter-element spacing of the antenna array and

λ is the wavelength at which the antenna array radiates.

In the Fourier domain, to create a broad null in some direction $\theta_i$, it suffices to take, for the weights, the inverse Fourier transform of the spectrum. Thus:

$$\tilde{W}(f') = W(f') - \sum_i W(f')\cdot g(f' - f_i') \tag{3}$$

$$\text{where } f_i' = \frac{d}{\lambda}\sin(\theta_i) \text{ and}$$

g(f') is a low-pass filter (LPF) with a desired bandwidth of the widened null width.

Those having ordinary skill in this art will readily recognize that the resulting vector of weights in the time domain $\tilde{w}$ will be of size 2m−1, where m is the length of the vector, that is, the number of antenna elements in the array.

Where, as here, the imposed low pass filter corresponding to g(f') is less than ideal, having regard to the limited number of antenna elements, it may be advantageous to implement the null broadening successively for each null (that is, for each interferer) viz.:

$$\tilde{W}(f')=W(f') \tag{4}$$

$$\tilde{W}_{i+1}(f')=\tilde{W}_i(f')-\tilde{W}_i(f')\cdot g(f'-f_i') \tag{5}$$

where i=1 . . . n and n is the number of interferers, with the drawback that the filter length of $\tilde{W}_{n+1}(f')$ goes from m to m+n·(m−1), assuming a length of m for g(f').

Thus, filtering is performed iteratively so that the filter order increases, by a convolution effect, for each interferer.

Where the number of interferers n is much less than the number of antenna elements m, a possible approach to reducing the complexity of computing the initial set of weights and performing the null broadening later could be limited to estimating the weights over only a subset of the elements, chosen so that when the weights that have been calculated are expanded in the null broadening process, the calculated weights do not exceed the original number of elements m.

However, practically, for cost and other reasons, the number of actual antenna elements is usually limited, so that such an approach is impractical. For instance, the exemplary scenario suggested herein uses an antenna array of length m=4.

Accordingly, as discussed below, it is proposed rather to predict the signature of an augmented or virtual antenna of additional length to fully define the effect of the null broadening. Such a prediction is relatively straightforward in the case of uniform linear arrays since the time delay of the incoming signal to the array is a linear function of the position of each element, again assuming a planar wave signal from the impinging waveform on the antenna array.

The prediction involves postulating a planar wave emanating from the wave along the direction of arrival and reaching each of the elements in turn. The virtual elements could be conceptually distributed anywhere among the physical elements of the physical array. Preferably, they are distributed to both ends of the physical array to reduce cumulative prediction errors.

The predicted array signature is determined purely by calculating the different times of arrival of the planar wave at each element, whether physical or virtual. Simulations have shown that such prediction can be made in the case of both linear and circular arrays and it is anticipated that any array geometry could be similarly accommodated.

By way of example, for the case where (m,n)=(4,2), it has been found safe to consider a virtual antenna array of length 2m−1, comprising the m=4 existing antenna elements and m−1=3, additional virtual antenna elements after processing the first and the second interferer.

Figure 2:
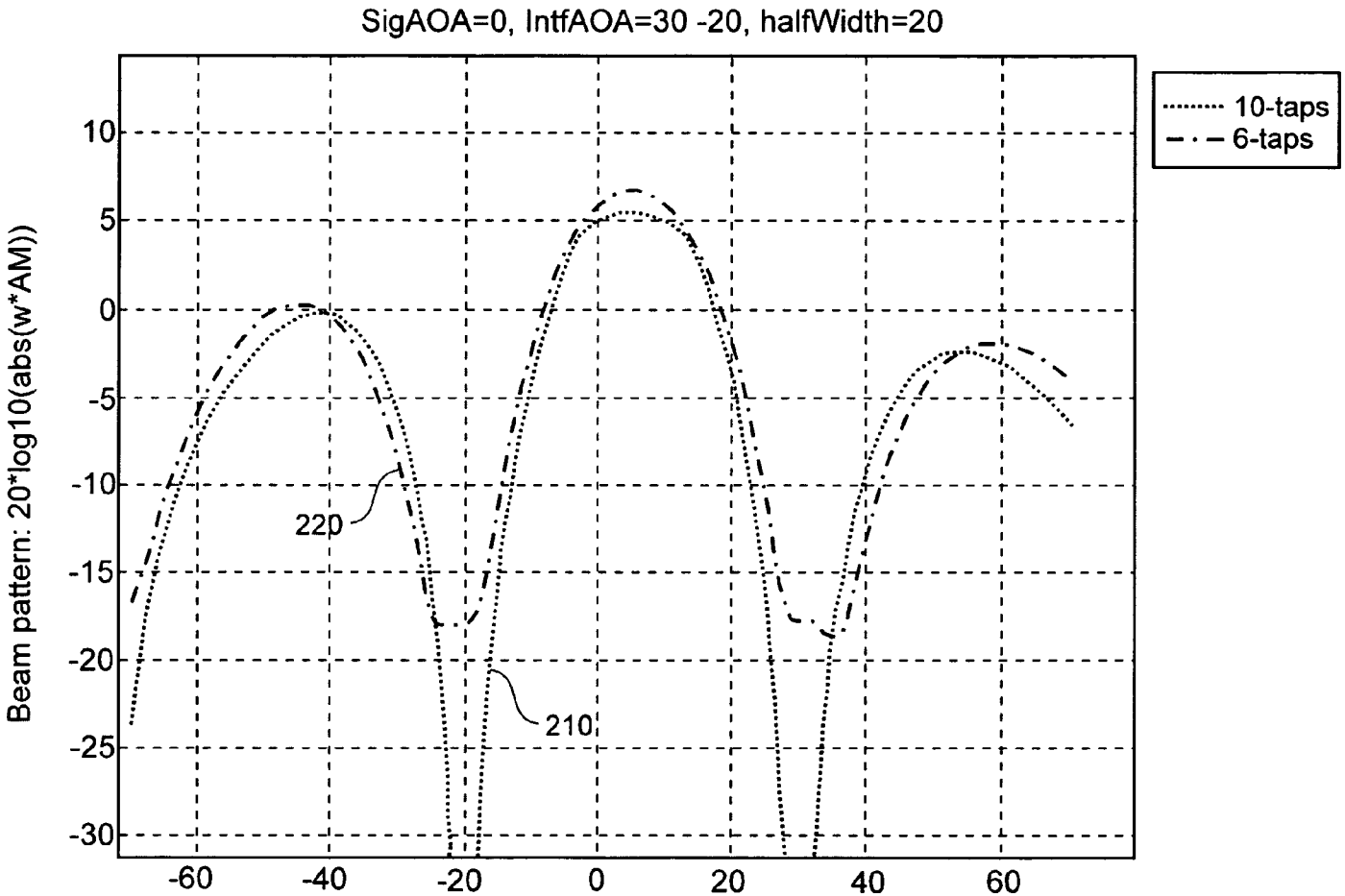
FIG. 2 is a block diagram illustrating the conceptual operation of the present invention.
Figure 3:
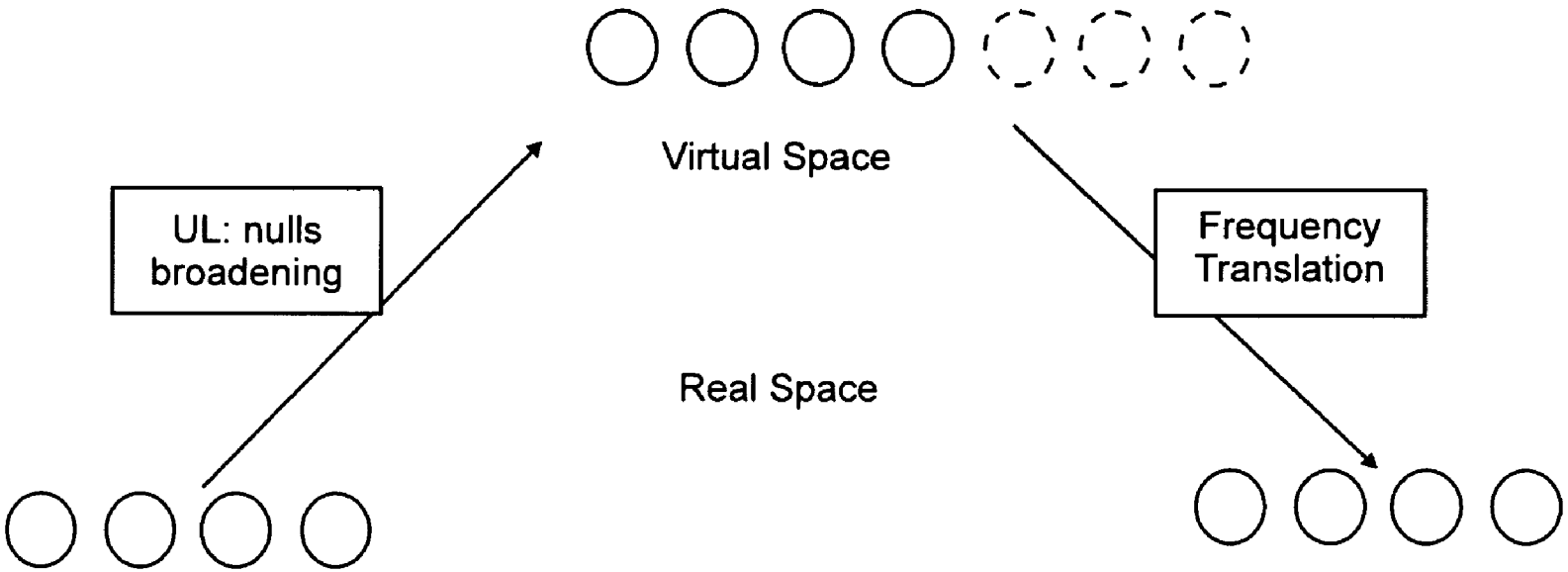
FIG. 3 is an exemplary graph of the beamformed response received by the base station of FIG. 1, after nulls-broadening in accordance with the operation described in FIG. 2 with three and seven virtual antenna elements respectively.

FIG. 2 shows a 10-tap curve 210 optimal implementation with a total of 10 antenna elements (six virtual elements) after processing the second interferer. FIG. 3 also shows a 6-tap curve 220 corresponding to the case of truncating the 10-taps filter to the dominant 6 consecutive coefficients (two virtual antenna elements). The Figure shows that such truncation, reducing computational complexity, did not significantly affect the nulls broadening performance.

As discussed above, the estimation of weights over all of the elements could be estimated from the uplink signals over the available physical antenna elements, in a manner well understood by those having ordinary skill in this art, and expanded for the additional virtual antenna elements, by using the broadening methodology set out in Equations 4 and Equations 5.

Then the null broadening approach is applied as discussed above, resulting in a longer vector of weights. As discussed above, for null broadening in the uplink direction, prediction of virtual array spatial signatures can be applied, for example as discussed above, based on linear time delay in the case of a linear array of uniform element spacing. In the downlink direction, of TDD systems, the weights derived in the uplink direction can be applied as a close approximation, as discussed above.

Because the length of the vector of weights exceeds the number of antenna array elements, the derived vector of weights is not directly used to combine the received signals for the uplink direction. While it is possible to complete virtual vector of weights, a virtual set received antenna signals is not generated. Rather, a shorter vector of weights having a length less than or equal to the number of antenna array elements is derived.

One suitable approach for so doing is frequency translation, in which the null broadened vector of weights is denoted $\hat{w}_2$ and the matrices $\hat{A}_1(\theta)$ and $\hat{A}_1(\theta)$ $A_1(\theta)$ and $A_2(\theta)$ contain the spatial signatures for the physical array and the augmented array (i.e. the physical array together with the derived virtual elements) respectively.

Generally, where the spatial signatures for the physical array and the augmented array correspond to the same physical angular directions, frequency translation is governed by the relation:

$$\hat{w}_1 = \underset{w_1}{\operatorname{argmin}} \left\| w_1 \hat{A}_1(\theta) - \hat{w}_2 \hat{A}_2(\theta) \right\|^2 \tag{6}$$

where $\hat{w}_1$ represents the vector of weights after null broadening but corresponding only to the number of antenna elements in the physical array, $\hat{w}_2$ represents the vector of weights after null broadening corresponding to the number of antenna elements in the augmented array, and $\theta$ represents a discrete set of angles.

Thus, the solution to Equation (6) may be expressed as a Least-Squares (LS) problem as:

$$\hat{w}_1 = \hat{w}_2 T \tag{7}$$

where $T = \hat{A}_2 \hat{A}_1^H (\hat{A}_1 \hat{A}_1^H)$ is the frequency translation of the spatial signatures.

Such an approach, in addition to achieving the desired null broadening, amounts to a mechanism to reduce complexity, particularly when the computation of weights, as here, involves matrix inversion.

Thus, where the directions of arrival for the desired users and the interferers are properly estimated, T can be computed from this information and the least squares problem may be applied to concentrate on the desired constraints, namely beam pointing in the direction of the desired users and/or generating nulls in the direction of interferers.

Alternatively, one could, for example as shown in FIG. 2, only consider a subset of the (for example) six dominant taps of the entire (for example 10 taps) augmented array and then perform a frequency translation from the truncated version of the augmented array down to the existing (four) taps of the physical array. The above-referenced complexity reduction becomes apparent as there would be a version of a 6×6 matrix rather than a 10×10 in the example.

In such case, it appears that the null broadening capabilities are maintained, but that there is some degradation in the null depth created as shown in FIG. 2, for the example of 6-taps 220. However, because in practical cases, nulls are not expected to be deeper than 25-30 dB from the peak power, such truncation may be appropriate.

Indeed, because the inventive method relies on good prediction of antenna array signatures and translation from the augmented array, truncation may even be preferable to pure frequency translation for a long augmented array.

Where the directions of arrival cannot be safely estimated, a random set of angles, which are preferably of uniform separation, could be considered. It appears, in this scenario, that the number of angles to sufficiently compute T to resolve the least squares problem with acceptable residual error, while avoiding singularities, would be slightly above twice the number of antenna elements m.

When nulls broadening is performed for TDD systems, the array spatial signatures $\hat{A}_1(\theta)$ are simply a subset of $\hat{A}_2(\theta)$ and the remaining elements of $\hat{A}_2(\theta)$ are obtained by prediction as discussed above.

If nulls broadening is planned for downlink transmissions of FDD systems, the array spatial signatures $\hat{A}_2(\theta)$ contain the steering vectors for the augmented antenna array at the uplink frequency, whereas $\hat{A}_1(\theta)$ contains the steering vectors of the actual antenna array elements measured at the downlink frequency.

Referring now to FIG. 3, there is shown a simplified diagram illustrating in conceptual fashion the operation of the present invention.

According to the (m,n)=(4,1) scenario, the null broadening operation transformed a real 4-dimensional subspace into an augmented virtual 7-dimensional subspace, comprising the real 4-dimensional subspace and 3 additional virtual dimensions. Since only 4 physical antenna signals are available for combining antenna signals, frequency translation is applied to derive a reduced 4-dimensional set of weights.

If, as contemplated, measured signals in controlled environments are used for prediction of the phases of the wave impinging on the virtual antenna array elements, calculating the theoretical expressions of spatial signatures may aid in improving the predictive process.

The present invention can be implemented in digital electronic circuitry, or in computer hardware, firmware, software, or in combination thereof. Apparatus of the invention can be implemented in a computer program product tangibly embodied in a machine-readable storage device for execution by a programmable processor; and methods actions can be performed by a programmable processor executing a program of instructions to perform functions of the invention by operating on input data and generating output. The invention can be implemented advantageously in one or more computer programs that are executable on a programmable system including at least one input device, and at least one output device. Each computer program can be implemented in a high-level procedural or object oriented programming language, or in assembly or machine language if desired; and in any case, the language can be a compiled or interpreted language.

Suitable processors include, by way of example, both general and specific microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in ASICs (application-specific integrated circuits).

It will be apparent to those skilled in this art that various modifications and variations may be made to the embodiments disclosed herein, consistent with the present invention, without departing from the spirit and scope of the present invention.

Other embodiments consistent with the present invention will become apparent from consideration of the specification and the practice of the invention disclosed therein.

Accordingly, the specification and the embodiments are to be considered exemplary only, with a true scope and spirit of the invention being disclosed by the following claims.

I claim:

1. A method of generating beamforming weights for a plurality of antenna elements in a physical array thereof, the method comprising:

estimating a direction of arrival of a co-channel interfering signal;

deriving a first series of beamforming weights corresponding to each antenna element in the physical antenna array, wherein the series of derived beamforming weights define a null in an angular direction from the physical antenna array corresponding to the direction of arrival of the interfering signal;

broadening the null to accommodate deviation of the estimated direction of arrival from a true direction of arrival of the signal;

identifying a series of virtual weights to accommodate information content of the broadened null corresponding to a virtual antenna array comprising a plurality of real antenna elements corresponding to the plurality of antenna elements of the physical array and a plurality of virtual antenna elements; and transforming the series of virtual weights to a second series of beamforming weights corresponding to each antenna element in the physical antenna array that incorporate the broadened null;

wherein the second series of beamforming weights may be applied to the plurality of physical antenna elements to minimize interference from the co-channel interferer during communications with a desired user.

2. A method of generating beamforming weights according to claim 1, wherein the step of estimating comprises measuring the direction of arrival.

3. A method of generating beamforming weights according to claim 1, wherein the step of estimating comprises predicting the direction of arrival.

4. A method of generating beamforming weights according to claim 1, wherein the step of estimating comprises noting local minima in signal response as a function of angular direction.

5. A method of generating beamforming weights according to claim 4, wherein the step of estimating comprises ranking the local minima according to signal power.

6. A method of generating beamforming weights according to claim 1, wherein the step of estimating comprises identifying the co-channel interferer from information contained in the signal therefrom.

7. A method of generating beamforming weights according to claim 1, wherein the step of deriving a first series of beamforming weights comprises defining a peak in a second angular direction corresponding to a second direction of arrival of a signal from the desired user.

8. A method of generating beamforming weights according to claim 1, wherein the step of broadening the null comprises calculating a Fourier transform of a vector of the first series of beamforming weights using an array corresponding to signal response of each of the physical array elements and applying a low pass filter thereto having a response and bandwidth corresponding to the broadened null.

9. A method of generating beamforming weights according to claim 8, wherein the step of applying a low pass filter thereto comprises convoluting an inverse Fourier transform of the Fourier transform with a signal response of the low pass filter.

10. A method of generating beamforming weights according to claim 9, wherein the step of identifying comprises generating a vector of the series of virtual weights having a length that is one less than twice the length of the vector of the first series of beamforming weights.

11. A method of generating beamforming weights according to claim 1, wherein the step of identifying comprises predicting a signature that would be received at the virtual antenna elements.

12. A method of generating beamforming weights according to claim 1, wherein the steps of deriving, broadening and identifying are repeated to define and broaden a further null in an angular direction from the physical antenna array corresponding to a direction of arrival of a signal from a further co-channel interferer.

13. A method of generating beamforming weights according to claim 1, wherein the step of transforming comprises truncating the series of virtual weights to a truncated series thereof.

14. A method of generating beamforming weights according to claim 1, wherein the step of transforming comprises translating the series of virtual weights to the second series of beamforming weights.

15. A method of generating beamforming weights according to claim 14, wherein the step of translating comprises calculating a translation matrix to map a large dimension space into a reduced dimension space.

16. A method of generating beamforming weights according to claim 15, wherein the step of calculating comprises pre-calculating the translation matrix across a plurality of specific angular directions corresponding to angles of interest.

17. A method of generating beamforming weights according to claim 15, wherein the step of calculating comprises precalculating the translation matrix across a plurality of random angular directions.

18. A method of generating beamforming weights according to claim 15, wherein the step of calculating comprises precalculating the translation matrix across a plurality of uniformly spaced angular directions.

19. A method of generating beamforming weights according to claim 1, for application to communications along an uplink channel of a communications system.

20. A method of generating beamforming weights according to claim 1, for application to communications along the downlink channel of a communication system.

21. A method of generating beamforming weights according to claim 20, wherein the step of deriving comprises appropriating a first set of beamforming weights from prior applications of the method to communications along the corresponding uplink channel.

22. A method of generating beamforming weights for a plurality of antenna elements in a physical array thereof, the method comprising:

deriving a first series of beamforming weights corresponding to each antenna element in the physical antenna array, wherein the series of derived beamforming weights define a null in an angular direction from the physical antenna array;

broadening the null to accommodate deviation in the angular direction;

identifying a series of virtual weights to accommodate information content of the broadened null corresponding to a virtual antenna array comprising a plurality of real antenna elements corresponding to the plurality of antenna elements of the physical array and a plurality of virtual antenna elements; and transforming the series of virtual weights to a second series of beamforming weights corresponding to each antenna element in the physical antenna array that incorporate the broadened null;

wherein the second series of beamforming weights may be applied to the plurality of physical antenna elements to minimize interference from a co-channel interfering signal during communications with a desired user.

23. A method of generating beamforming weights according to claim 22, wherein the step of transforming comprises truncating the series of virtual weights to a truncated series thereof.

24. A method of generating beamforming weights according to claim 22, wherein the step of transforming comprises translating the series of virtual weights to the second series of beamforming weights.

25. A method of generating beamforming weights according to claim 24, wherein the step of translating comprises calculating a translation matrix to map a large dimension space into a reduced dimension space.

26. A method of generating beamforming weights according to claim 25, wherein the step of calculating comprises precalculating the translation matrix across a plurality of specific angular directions corresponding to angles of interest.

27. A beamforming system for communicating with a desired user along a physical antenna array having a plurality of antenna elements, comprising:

an estimator for identifying an estimated direction of arrival of a co-channel interfering signal;

a beamformer for deriving a first set of beamforming weights corresponding to each antenna element in the physical antenna array, wherein the series of derived beamforming weights defining a null in an angular direction from the physical antenna array corresponding to the direction of arrival;

a null broadener to accommodate deviation of the estimated direction of arrival from a true direction of arrival of the signal in a broadened null;

a mapper for mapping the first set of beamforming weights into a series of virtual weights adapted to accommodate information content of the broadened null and corresponding to a virtual antenna array comprising a plurality of real antenna elements corresponding to the plurality of antenna elements of the physical antenna array and a plurality of virtual antenna elements; and a transformer for transforming the series of virtual weights to a second series of beamforming weights corresponding to each antenna element in the physical antenna array that incorporate the broadened null;

wherein the second series of beamforming weights may be applied to plurality of antenna elements in the physical antenna array to minimize interference from the co-channel interfering signal during communications with a desired user.

28. A processor operatively coupled to a plurality of antenna elements in a physical antenna array thereof, comprising:

an estimator for estimating a direction of arrival of a signal from a co-channel interfering signal;

a beamformer for deriving a first series of beamforming weights corresponding to each antenna element in the physical antenna array, wherein the series of derived beamforming weights define a null in an angular direction from the physical antenna array corresponding to the direction of arrival;

a filter for broadening the null to accommodate deviation of the estimated direction of arrival from a true direction of arrival of the signal;

a modeler for identifying a series of virtual weights to accommodate information content of the broadened null corresponding to a virtual antenna array comprising a plurality of real antenna elements corresponding to the plurality of antenna elements of the physical array and a plurality of virtual antenna elements; and a translation machine for transforming the series of virtual weights to a second series of beamforming weights corresponding to each antenna element in the physical antenna array that incorporate the broadened null;

wherein the second series of beamforming weights may be applied to the plurality of physical antenna elements to minimize interference from the co-channel interfering signal during communications with a desired user.

29. A computer-readable medium in a processor operatively coupled to a plurality of antenna elements in a physical antenna array thereof, the medium having stored thereon, computer-readable and computer-executable instructions which, when executed by a processor, cause the processor to perform steps comprising:

estimating a direction of arrival of co-channel interfering signal;

deriving a first series of beamforming weights corresponding to each antenna element in the physical antenna array, wherein the series of derived beamforming weights define a null in an angular direction from the physical antenna array corresponding to the direction of arrival;

broadening the null to accommodate deviation of the estimated direction of arrival from a true direction of arrival of the signal;

identifying a series of virtual weights to accommodate information content of the broadened null corresponding to a virtual antenna array comprising a plurality of real antenna elements corresponding to the plurality of antenna elements of the physical array and a plurality of virtual antenna elements; and transforming the series of virtual weights to a second series of beamforming weights corresponding to each antenna element in the physical antenna array that incorporate the broadened null;

wherein the second series of beamforming weights may be applied to the plurality of physical antenna elements to minimize interference from the co-channel interfering signal during communications with a desired user.

* * * * *